US010384228B2

(12) United States Patent
Fee et al.

(10) Patent No.: US 10,384,228 B2
(45) Date of Patent: Aug. 20, 2019

(54) TOUCH UP PAINTER

(71) Applicant: Shur-Line, Mooresville, NC (US)

(72) Inventors: Garry C. Fee, Huntersville, NC (US); John C. Morphey, Concord, NC (US)

(73) Assignee: SHUR-LINE, Mooresville, NC (US)

( * ) Notice: Subject to any disclaimer, the term of this patent is extended or adjusted under 35 U.S.C. 154(b) by 0 days.

(21) Appl. No.: 14/794,310

(22) Filed: Jul. 8, 2015

(65) Prior Publication Data

US 2016/0008843 A1 Jan. 14, 2016

Related U.S. Application Data

(60) Provisional application No. 62/022,052, filed on Jul. 8, 2014.

(51) Int. Cl.

| | |
|---|---|
| ***B43M 11/02*** | (2006.01) |
| ***B05C 17/03*** | (2006.01) |
| *B05C 17/035* | (2006.01) |
| *B05C 17/02* | (2006.01) |

(52) U.S. Cl.

CPC ..... *B05C 17/0325* (2013.01); *B05C 17/0217* (2013.01); *B05C 17/0357* (2013.01)

(58) Field of Classification Search

CPC ..... B05C 17/00; B05C 17/02; B05C 1/00; B05C 21/00

USPC ..... 401/219, 208, 147, 146, 183

See application file for complete search history.

(56) References Cited

U.S. PATENT DOCUMENTS

| | | | | |
|---|---|---|---|---|
| 4,496,408 | A * | 1/1985 | Hahn | B29C 51/06 156/73.5 |
| 4,496,513 | A * | 1/1985 | Ishikawa | B29C 45/14598 249/124 |
| 6,053,650 | A * | 4/2000 | Bennett | B05C 17/0325 401/208 |
| 7,396,179 | B2 * | 7/2008 | Lange | B43K 8/003 401/218 |
| 7,959,370 | B2 * | 6/2011 | Pierson | A61C 3/005 401/126 |
| 8,739,992 | B2 * | 6/2014 | Ogata | B29C 45/14622 132/286 |
| 8,888,394 | B2 * | 11/2014 | Caulier | A45D 34/041 401/219 |
| 2003/0233721 | A1 * | 12/2003 | Prince | B05C 17/02 15/230.11 |
| 2004/0175224 | A1 * | 9/2004 | Hermansen | A45D 34/045 401/126 |
| 2005/0169693 | A1 * | 8/2005 | Serio | B43M 11/06 401/219 |

(Continued)

*Primary Examiner* — Jennifer C Chiang

(74) *Attorney, Agent, or Firm* — McGuireWoods LLP

(57) ABSTRACT

A liquid applicator for applying a liquid to a surface with an improved liquid delivery process. The liquid applicator includes a container having a container body that includes an opening and a chamber that is configured to receive and hold the liquid; and, a housing assembly removably attached to the container, the housing assembly including a liquid application element and a nozzle that delivers the liquid from the chamber to the application element, wherein the nozzle is configured to deliver the liquid from the chamber to the application element when the housing assembly is positioned in a first position with respect to the container, and wherein the container body comprises an interface, a main body portion, and a base.

25 Claims, 9 Drawing Sheets

(56) References Cited

U.S. PATENT DOCUMENTS

| | | | | |
|---|---|---|---|---|
| 2006/0067784 | A1* | 3/2006 | Serio | B05C 17/0357 401/219 |
| 2006/0239760 | A1* | 10/2006 | Chen | B05C 17/00513 401/219 |
| 2007/0048068 | A1* | 3/2007 | Bullivant | A46B 11/0013 401/220 |
| 2009/0020440 | A1* | 1/2009 | Pierson | A61C 3/005 206/63.5 |
| 2011/0311297 | A1* | 12/2011 | Cazzola | B05C 17/024 401/147 |
| 2012/0199589 | A1* | 8/2012 | Timmer | A45D 34/041 220/378 |
| 2013/0114990 | A1* | 5/2013 | Sandahl | B05C 17/0222 401/147 |
| 2013/0251440 | A1* | 9/2013 | Young | A45D 34/041 401/213 |
| 2015/0307731 | A1* | 10/2015 | Bechtel | B65D 25/34 428/36.9 |
| 2016/0008838 | A1* | 1/2016 | Fee | B05C 17/00 118/264 |

* cited by examiner

TOUCH UP PAINTER

CROSS REFERENCE TO PRIOR APPLICATION

This application claims benefit and priority to U.S. Provisional Application No. 62/022,052, filed Jul. 8, 2014, titled "Touch Up Painter," the disclosure of which is incorporated by reference herein in its entirety.

FIELD OF DISCLOSURE

The present disclosure relates generally to a liquid applicator, and more particularly, it relates to a liquid applicator with an improved liquid delivery process comprising a container and a housing assembly with a liquid application element and a nozzle.

BACKGROUND OF THE DISCLOSURE

Liquid applicators such as, for example, paint brushes, paint rollers, and paint pads are well known in the art. Brushes allow for accurate paint application and are readily available in a wide array of sizes. Paint rollers are often used to apply paint to relatively large surfaces, e.g., walls, ceilings, and the like. Foam paint pads can be used to apply paint to surfaces having intricate textures. Moreover, such paint pads often have straight or angular edges enabling paint application along a straight trim line or to a corner.

During use, however, conventional liquid applicator, such as, for example, a paint applicator, must frequently be loaded with paint from a non-integral, secondary source such as, for example, a paint can, a roller tray, and the like. Such paint loading can be messy due to e.g., dripping, splattering, and the like, and wasteful due to paint adhering to the sides of the paint can, roller tray, paint applicator, and the like. Exposing paint in this fashion can result in paint contamination and such contaminated paint can result in inferior finishes. Additionally, the secondary source must be refilled with paint each time a user wants to perform a paint job, thereby wasting time and paint each time a paint job is undertaken.

Moreover, cleaning such conventional paint applicators and the associated loading source can be messy and time-consuming. For example, paint roller covers must be removed from the associated paint roller device by grasping the paint soaked paint roller cover and pulling it off of the paint roller assembly frame. Subsequently, the user's hands must be thoroughly cleaned. Further, the secondary sources must be refilled with paint each time a user wants to perform a paint job, thereby wasting time and paint each time a paint job (touch-up or larger) is undertaken.

The currently available paint applicators address some of these concerns but their size is often unnecessarily large for a job such as, for example, a touch up painting. Additionally, there is a need for an improved paint delivery process from a container of the paint applicator to the paint application element (e.g., a roller, a pad, or the like) in an efficient manner.

Accordingly, there exists an unfulfilled need for a liquid applicator with an improved delivery process that can apply e.g., a paint, in an efficient manner without constant reloading and to a targeted area.

SUMMARY OF THE DISCLOSURE

According to an aspect of the present disclosure, a liquid applicator for applying a liquid to a surface is disclosed. The liquid applicator includes a container having a container body that includes an opening and a chamber that is configured to receive and hold the liquid; and, a housing assembly removably attached to the container, the housing assembly including a liquid application element and a nozzle that delivers the liquid from the chamber to the application element, wherein the nozzle is configured to deliver the liquid from the chamber to the application element when the housing assembly is positioned in a first position with respect to the container, and wherein the container body comprises an interface, a main body portion, and a base.

The interface may be integrally formed with the main body portion and the base.

The main body portion may include a wall having a substantially uniform thickness. The main body portion may also include a wall that tapers such that the diameter of the main body portion proximate the base is smaller than the diameter of the main body portion proximate the interface. The interface may include at least one thread.

The liquid applicator may further include a cap that may be affixed to the housing assembly, so as to envelope and enclose the applicator element. The main body portion may include a wall made of polypropylene (PP).

The main body portion may further include an overmold material which may include a thermoplastic elastomer (TPE).

The container may be substantially translucent or transparent. The container body may include a material that is configured to flex in response to a force applied to the container body, thereby allowing a user to force the liquid from the chamber and through the opening by squeezing the container body.

The application element may include a flocked foam. The application element may also include an adhered fabric. The adhered fabric may include e.g., woven fabric, knit fabric, and the like.

The base of the container body may be configured to contact a surface and support the liquid applicator in a predetermined position.

In another aspect of the present disclosure, a container is disclosed. The container includes a chamber the receives and holds a liquid; and a container body that comprises an interface, a base and a main body that has an annular side wall extending upward and outward from a periphery of the base, wherein the annular side wall forms the chamber and wherein the container body comprises an opening that provides access to the chamber and allows the liquid to pass there-through.

In yet another aspect of the present disclosure, an applicator is disclosed. The applicator may include a container wherein the container further includes a chamber the receives and holds a liquid; and a container body that comprises an interface, a base and a main body that has an annular side wall extending upward and outward from a periphery of the base, wherein the annular side wall forms the chamber and wherein the container body comprises an opening that provides access to the chamber and allows the liquid to pass there-through.

The applicator may further include an application element. The application element may include a switch roller; and a cap covering the switch roller.

The switch roller may include an adhered fabric; or a flocked foam; or the liquid includes a paint, a lacquer, a sealer, an ink, a varnish, a stain, or a dye; the main body may include a thermoplastic elastomer; or the main body may include a thickness of about 1.5 mm; or the base may include a thermoplastic elastomer; or the base may be formed as a single piece with the main body.

The base may be connected to the main body with an adhesive.

The container body may include a polypropylene.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

Figure 1:
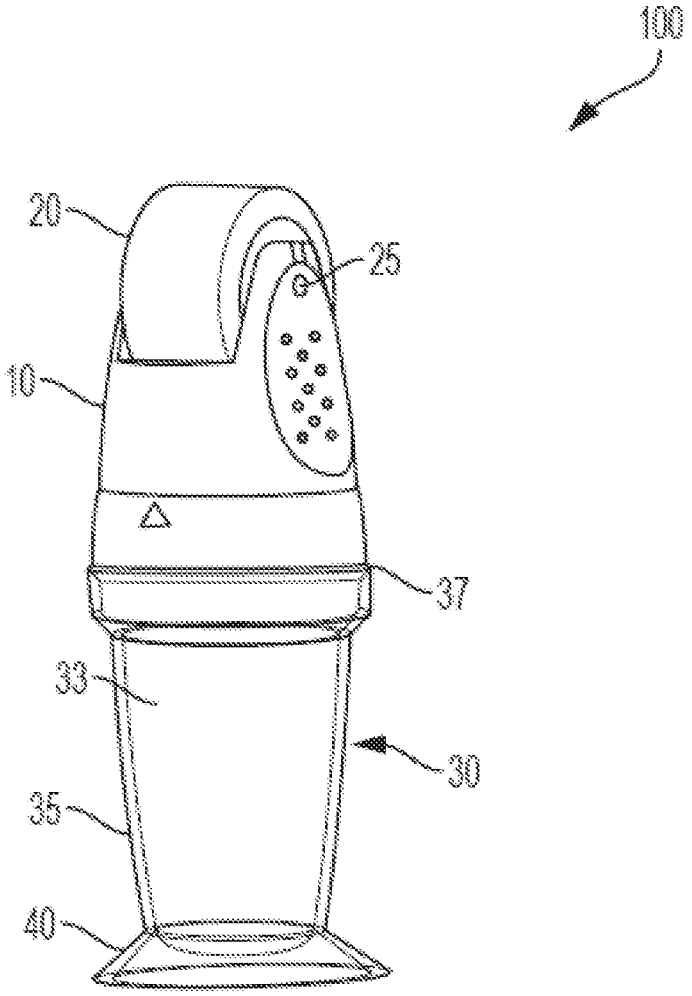
FIG. 1 shows an example of a liquid applicator that is constructed according to the principles of the disclosure.

The present disclosure is further described in the detailed description that follows.

DETAILED DESCRIPTION OF THE DRAWINGS

The disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

The terms "including", "comprising" and variations thereof, as used in this disclosure, mean "including, but not limited to", unless expressly specified otherwise.

The terms "a", "an", and "the", as used in this disclosure, means "one or more", unless expressly specified otherwise.

Although process steps, method steps, or the like, may be described in a sequential order, such processes and methods may be configured to work in alternate orders. In other words, any sequence or order of steps that may be described does not necessarily indicate a requirement that the steps be performed in that order. The steps of the processes or methods described herein may be performed in any order practical. Further, some steps may be performed simultaneously.

Figure 2:
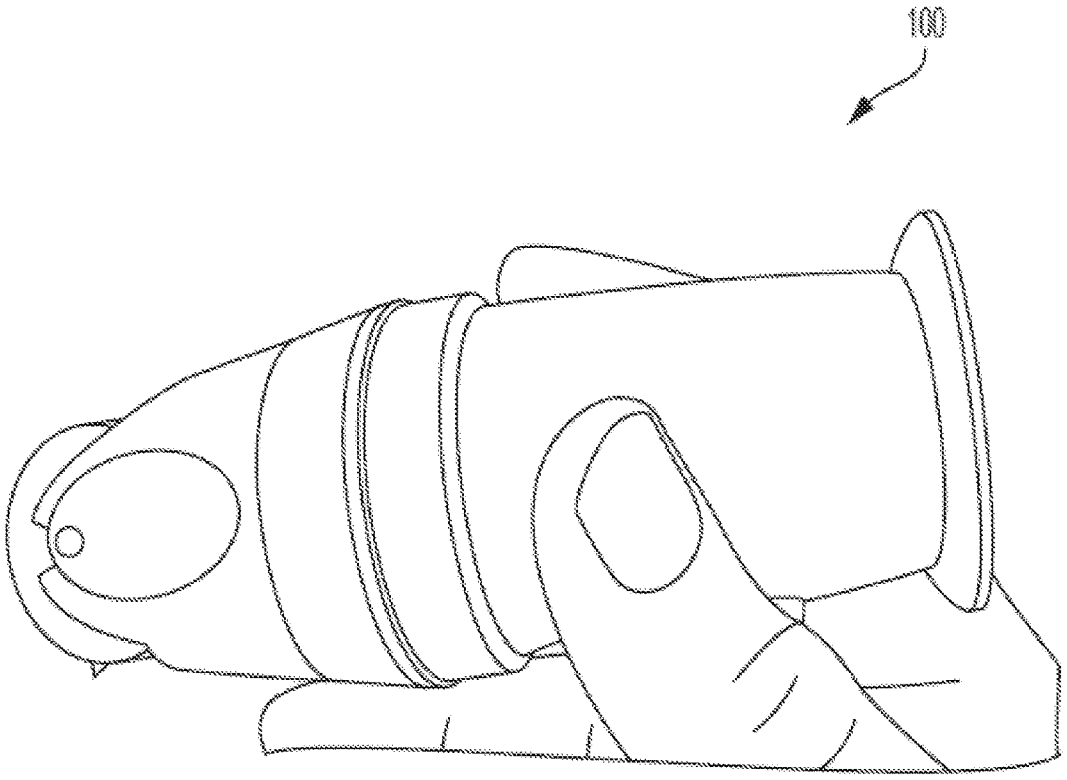
FIG. 2 shows a side view of an example of a liquid applicator that is constructed according to the principles of the disclosure.
Figure 10:
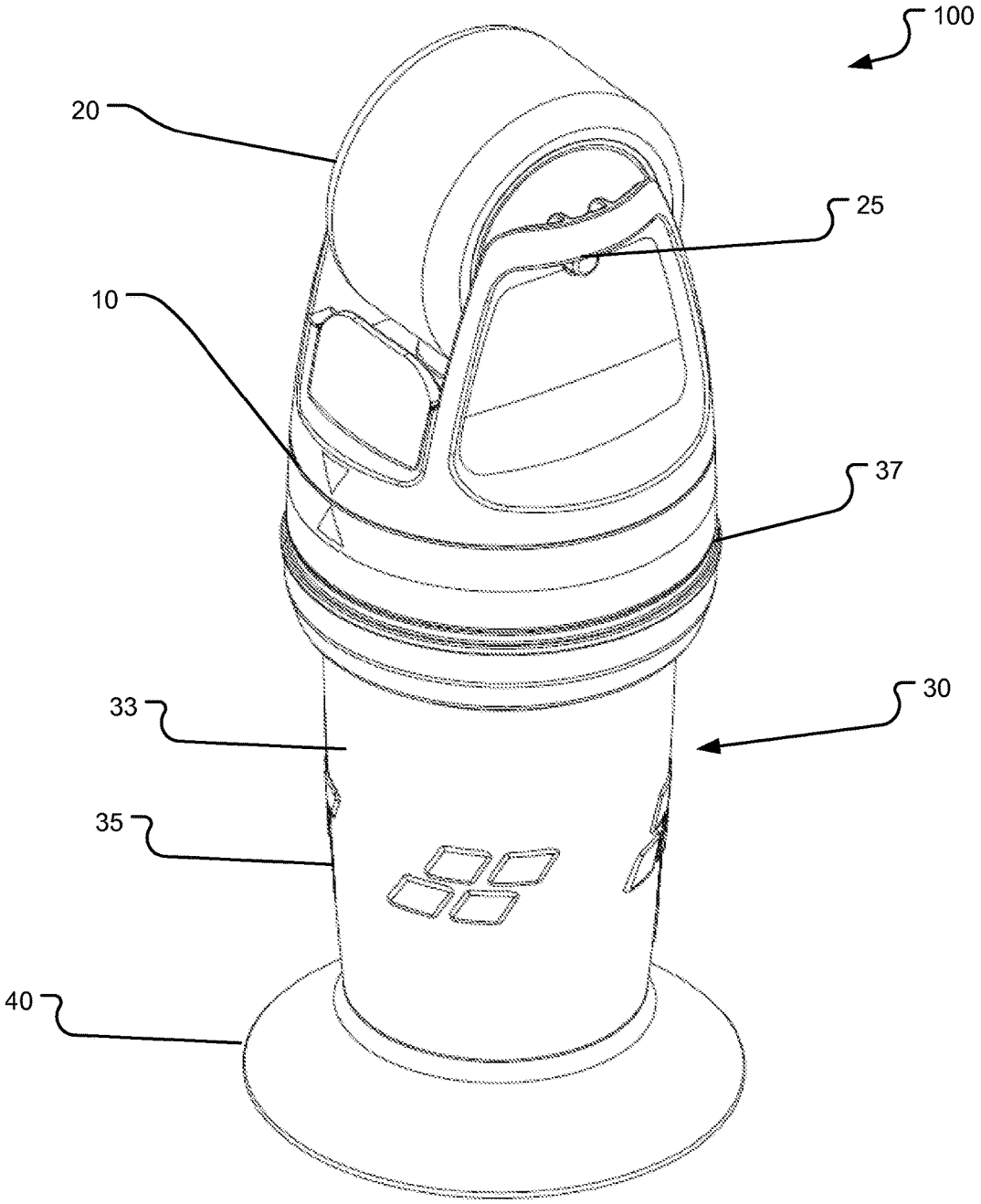
FIG. 10 shows yet another example of a liquid applicator that is constructed according to the principles of the disclosure.

FIGS. 1-2, and 10 show an example of a liquid applicator 100 for applying a liquid to a surface that is constructed in accordance with the principles of this disclosure. The liquid applicator 100 includes a container 30 having a container body 33 that includes an opening and a chamber that is configured to receive and hold the liquid; and, a housing assembly 10 removably attached to the container 30, the housing assembly 10 including a liquid application element 20 and a nozzle (not shown) that delivers the liquid from the chamber 33 to the application element 20, wherein the nozzle is configured to deliver the liquid from the chamber to the application element 20 when the housing assembly 10 is positioned in a first position with respect to the container 30, and wherein the container body 33 includes an interface 37, a main body portion 35, and a base 40.

The interface 37 may be integrally formed with the main body portion 35 and the base 40.

The main body portion 35 may include a wall having a substantially uniform thickness. The thickness may include e.g., 1.5 mm. The main body portion 35 may also include a wall that tapers such that the diameter of the main body portion 35 proximate the base 40 is smaller than the diameter of the main body portion 35 proximate the interface 37.

The interface 37 may include at least one thread (not shown). The thread may be used to attach the container 30 to a housing assembly 10 which may include a corresponding groove(s). The interface 37 may also include a snap-fit interference engagement to seal the housing assembly 10 to the container 30. Such a snap-fit interference engagement allows a user to quickly remove the housing assembly 10 from the container 30 and fill and/or empty the liquid of the container 30. The container 30 and the housing assembly 10 may also be removably attached to each other via e.g., a fastening mechanism, an adhesive, or the like.

The liquid applicator 100 may further include a cap (not shown) that may be affixed to the housing assembly 10, so as to envelope and enclose the applicator element 20. The housing assembly may include one or more sealable mean e.g., slots, channels, or the like.

The cap may include an annular channel or a groove for releasably receiving the housing assembly 10. The annular channel of the cap may include one or more sealable mean e.g., tabs, posts, ribs or the like, that are adapted to interact with slots and channels of the housing assembly 10. The sealable means of the cap and the housing assembly 10 may correspond to each other's location and be used to facilitate coupling and/or locking of the cap to the housing assembly 10.

The main body portion 35 may include a wall made of polypropylene (PP). The main body portion 35 may further include an overmold material which may include a thermoplastic elastomer (TPE).

The container 30 may be substantially translucent or transparent. The container body 33 may include a material that is configured to flex in response to a force applied to the container body 33, thereby allowing a user to force the liquid from the chamber and through the opening by squeezing the container body 33. The liquid may include includes e.g., a paint, a lacquer, a sealer, an ink, a varnish, a stain, a dye, or the like.

The application element 20 may include e.g., a paint pad, a paint roller cover, or the like. The application element 20 may further include e.g., a flocked foam, an adhered fabric, or the like. The base of the container body 33 may be configured to contact a surface and support the liquid applicator 100 in a predetermined position e.g., standing.

The liquid applicator 100 may also include an axel 25 that is connected to the application element 20. The axel 25 may be integrally formed with the application element 20. The application element 20 may include a core (not shown) having an outer circumferential surface configured to be rolled along a surface and to apply (or remove) paint from the adjacent surface. The core may be sized so as to be fitted about the axle 25. The core may be formed from a thermoplastic material, but other conventional materials suitable for core manufacture may also be used.

The liquid applicator 100 may also include a pile fabric (not shown) secured to the core. The pile fabric holds and retains paint until the paint is applied to a surface such as a wall. The core may be covered by various pile fabric materials such as, for example, flocked foam, fabric nap, mohair, natural or synthetic sponge, felt, and the like, for the adsorption and application of a liquid (e.g., paint), as is conventionally known.

The base 40 may include a thermoplastic elastomer. The base 40 may also be formed as a single piece with the main body portion 35. Alternatively (or additionally), the base 40 may be formed as a separate piece from the main body portion 35. The base 40 be connected to the main body portion 35 with e.g., a fastening mechanism, an adhesive, or the like.

The container body 33 may include e.g., PP, TPE, or the like.

Figure 3:
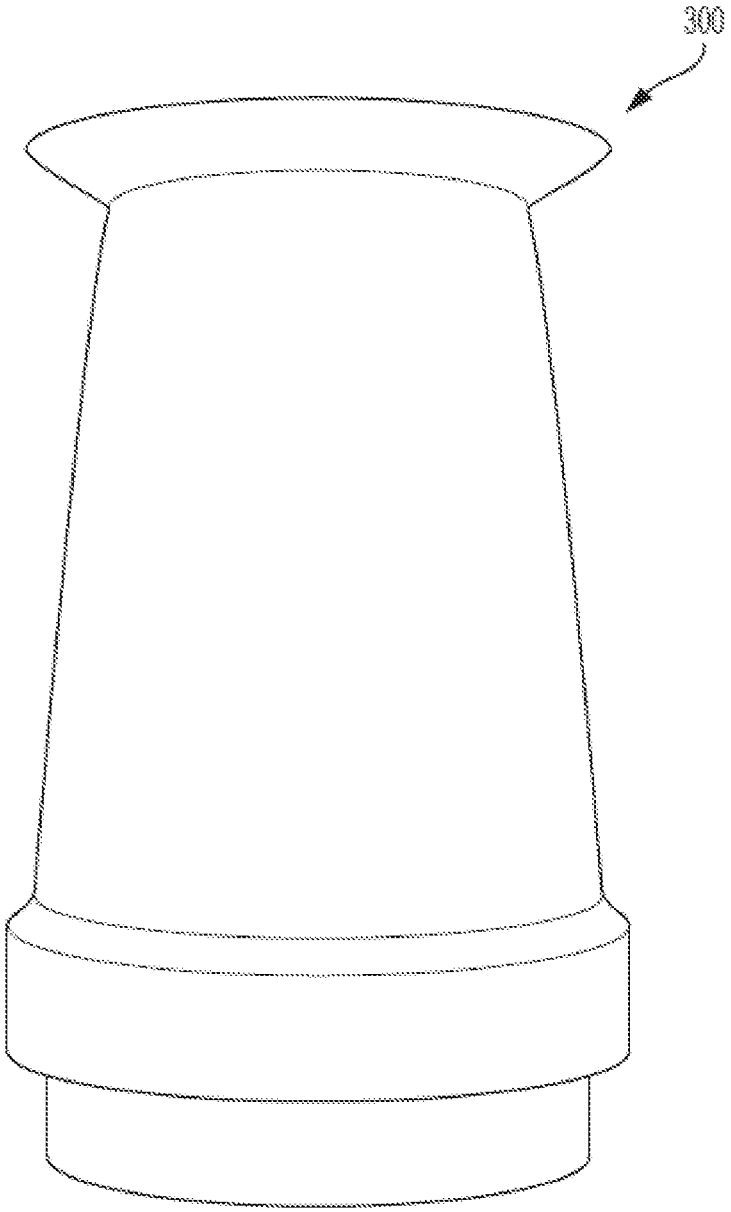
FIG. 3 shows an example of a chamber of a liquid applicator in accordance with the principles of the disclosure.

FIG. 3 shows a chamber 300 of a liquid applicator that is constructed in accordance with the principles of the disclosure. The chamber 300 may include a body profile that steps inward as to minimize a wall thickness. This may save up to e.g., 60% less material than an existing liquid applicator that is known in the art. The chamber 300 may include a height of greater or less than 3.08 inches. In the preferred embodiment to the present disclosure, the chamber 300 may include a height of around 3.08 inches.

Figure 4:
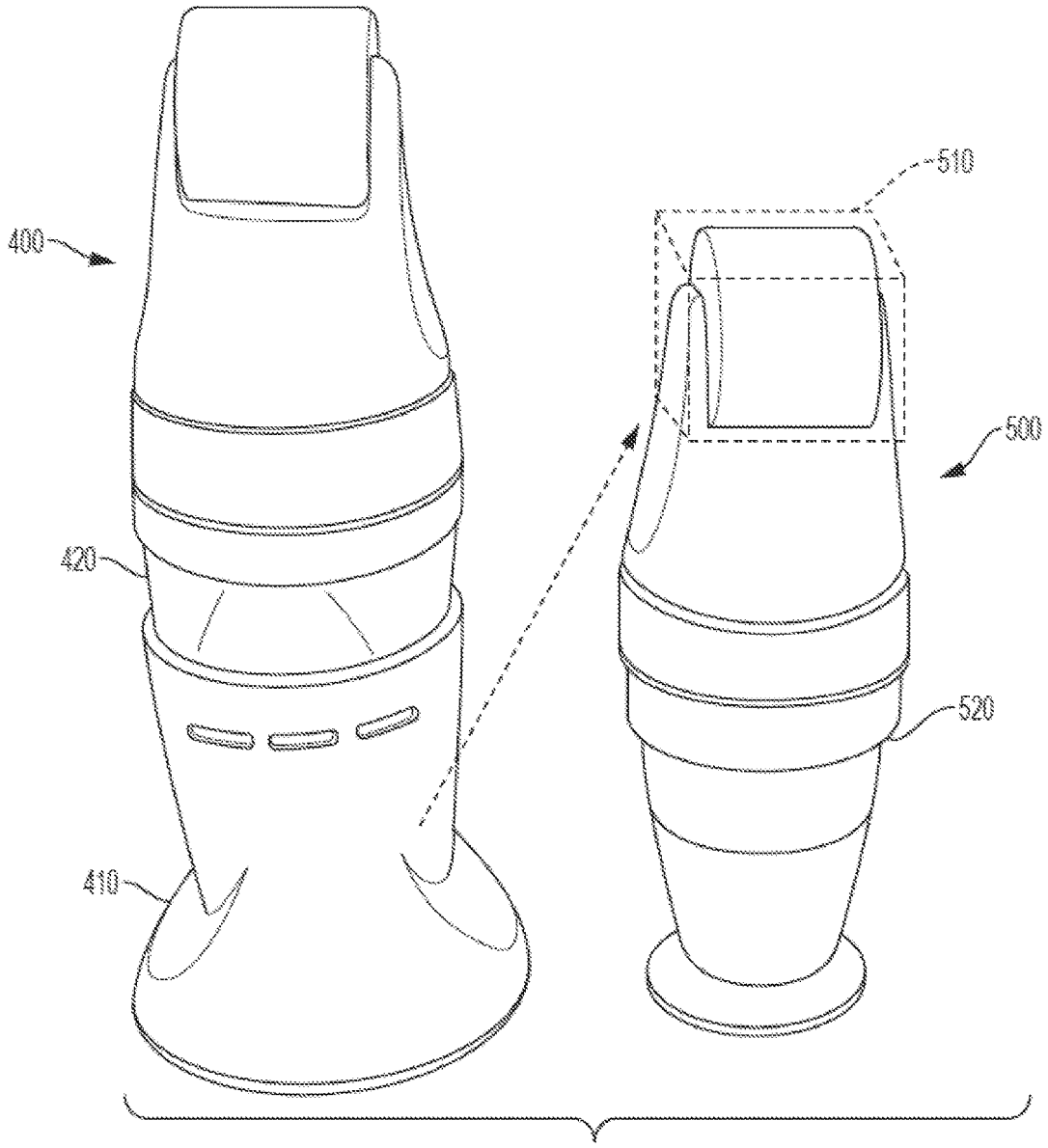
FIG. 4 shows an existing liquid applicator in comparison to an example of a liquid applicator that is constructed according to the principles of the disclosure.

FIG. 4 shows a comparison between an existing liquid applicator 400 known in the art and a liquid applicator 500 that is constructed according to the principles of the disclosure. The existing liquid applicator 400 includes a stand portion 410 that is not found in the liquid applicator 500, which is configured to stand without an additional and/or external stand e.g., stand 410. The portion of materials used to create the stand 410 may now be utilized to create a cap 510 for the liquid applicator 500.

The liquid applicator 500 may also include a chamber 520 that is shorter in height when compared to a chamber 420 found in the existing liquid application 400. This may prove beneficial for using the liquid applicator in a process such as, for example, a touch up painting, where a large capacity chamber is not required. This may save material and labor costs in manufacturing a liquid applicator.

Figure 5:
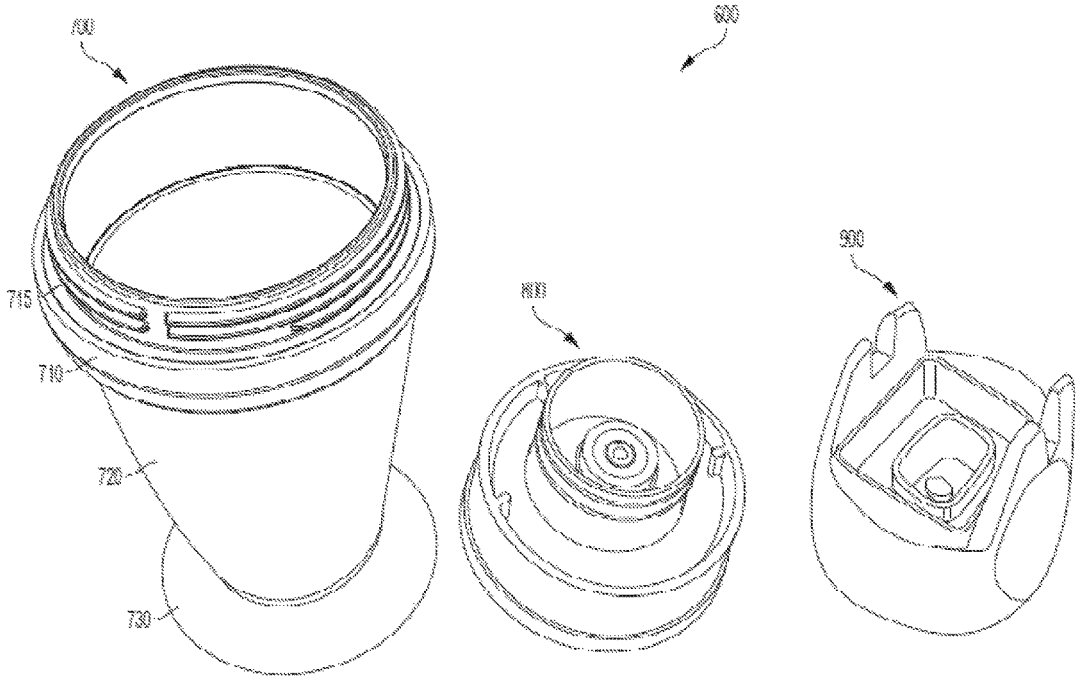
FIG. 5 shows yet another example of a liquid applicator in its individual parts that is constructed according to the principles of the disclosure.

FIG. 5 shows yet another example of a liquid applicator 600 for applying a liquid to a surface that is constructed according to the principles of the disclosure. The liquid applicator 600 is shown in its individual parts. The liquid applicator 600 includes a reservoir 700 which includes an opening and a chamber that is configured to receive and hold a liquid; and a housing assembly that is configured to be removably attached to the reservoir 700. The housing assembly may include a body/sealing housing 800 and a liquid distribution head 900 that delivers the liquid from the chamber to the body/sealing housing 800. The body/sealing housing 800 may be configured to deliver the liquid from the chamber to the liquid distribution head 900 when the housing assembly is positioned in a first position with respect to the reservoir 700. The reservoir 700 may include an interface 710, a main body portion 720, and a base 730.

The interface 710 may be integrally formed with the main body portion 720 and the base 730. Alternatively, the interface 710 may be formed as a separate piece that is removably attached to the main body portion 720 and the base 730 via e.g., an adhesive, a fastening mechanism, a snap-fit mechanism, or the like.

The main body portion 720 may include a wall having a substantially uniform thickness. The main body portion 720 may also include a wall that tapers such that the diameter of the main body portion proximate the base 730 is smaller than the diameter of the main body portion proximate the interface 710. The main body portion 720 may include a wall made of e.g., polypropylene, thermoplastic elastomer, and the like.

The base 730 may be formed as a single piece with the main body portion 720. Alternatively, the base 730 may be formed as a separate piece that may be attached to the main body portion 720 by e.g., an adhesive, a fastening mechanism, or the like.

Referring to FIGS. 5-11 concurrently, the body/sealing housing 800 may include a bottom side which interfaces with the interface 710. The interface 710 may include at least one thread 715 to be used in removably attaching with the body/sealing housing 800 which may include a corresponding groove(s) 820. Alternatively, the interface 710 may also include a snap-fit interference engagement to seal the body/sealing housing 800 to the reservoir 700.

Figure 6:
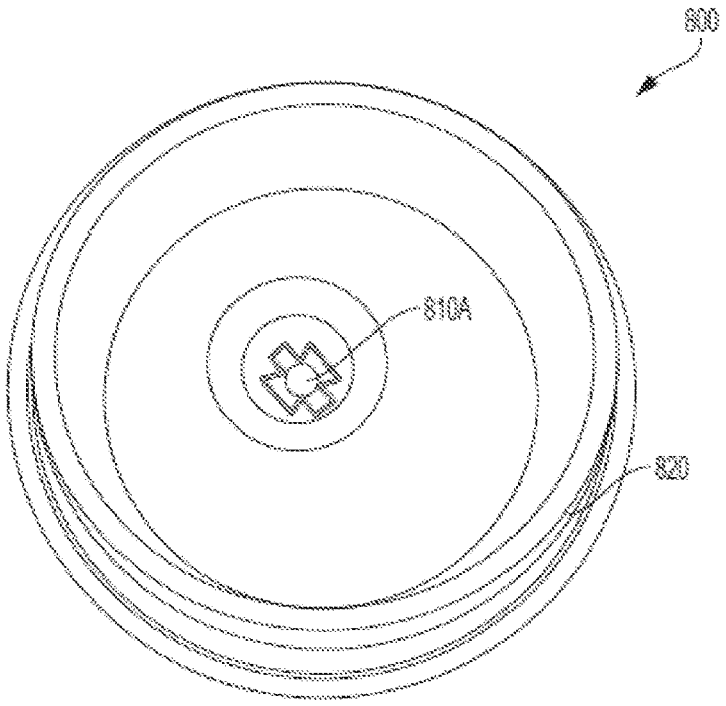
FIG. 6 shows a bottom view of an example of body/sealing housing that is constructed according to the principles of the disclosure.
Figure 7:
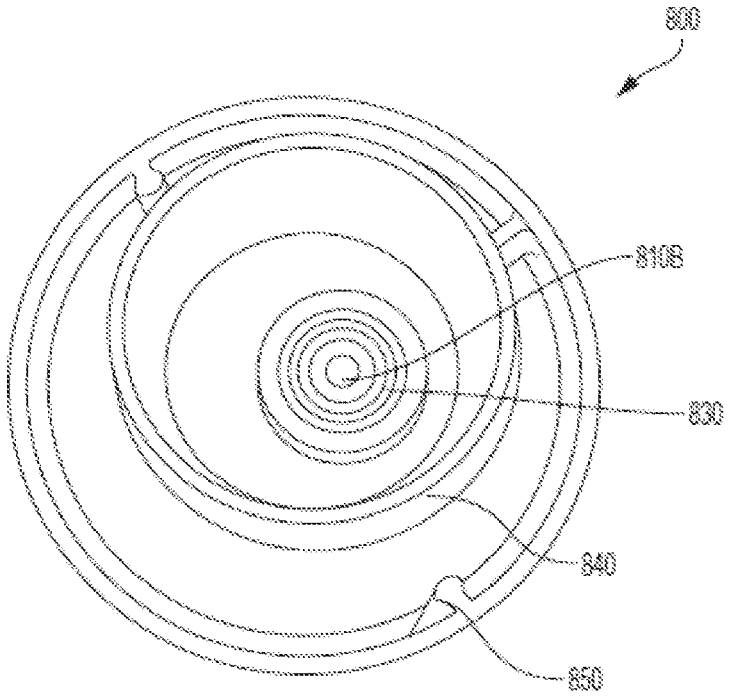
FIG. 7 shows a top view of an example of body/sealing housing that is constructed according to the principles of the disclosure.

The bottom side of the body/sealing housing 800 may include an aperture 810A which may be configured to collect and distribute the liquid to an aperture 810B which is located on top side of the body/sealing housing 800. The aperture 810B then distributes the liquid to the liquid distribution head 900. As shown in FIGS. 6-7, the apertures 810A and 810B may be substantially eccentric. Alternatively, the apertures 810A and 810B may be substantially concentric.

Figure 8:
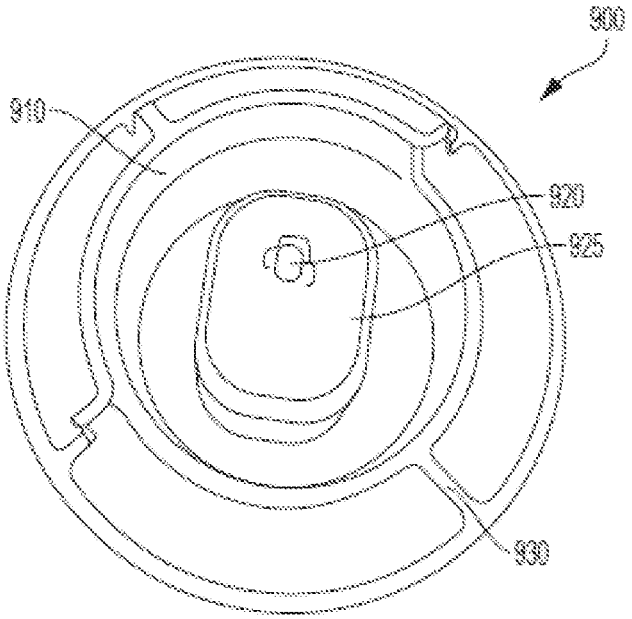
FIG. 8 shows a bottom view of an example of a liquid distribution head that is constructed according to the principles of the disclosure.
Figure 9:
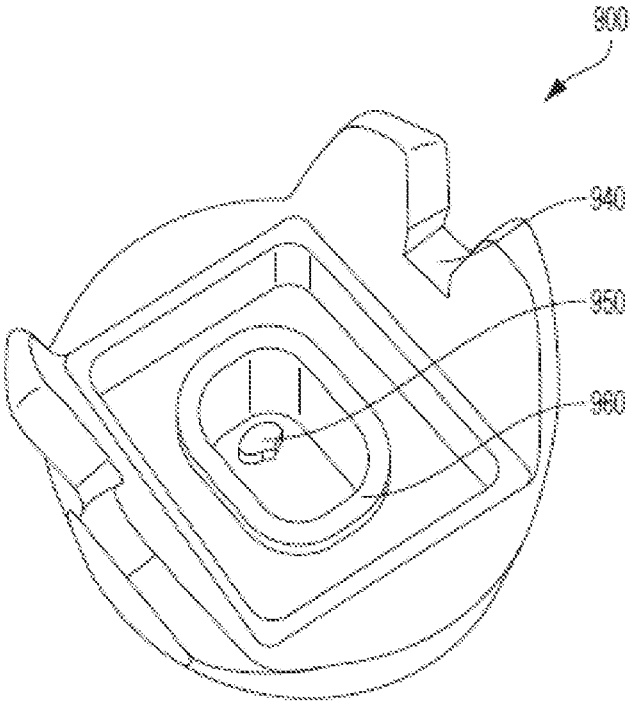
FIG. 9 shows a top view of an example of a liquid distribution head that is constructed according to the principles of the disclosure.
Figure 11:
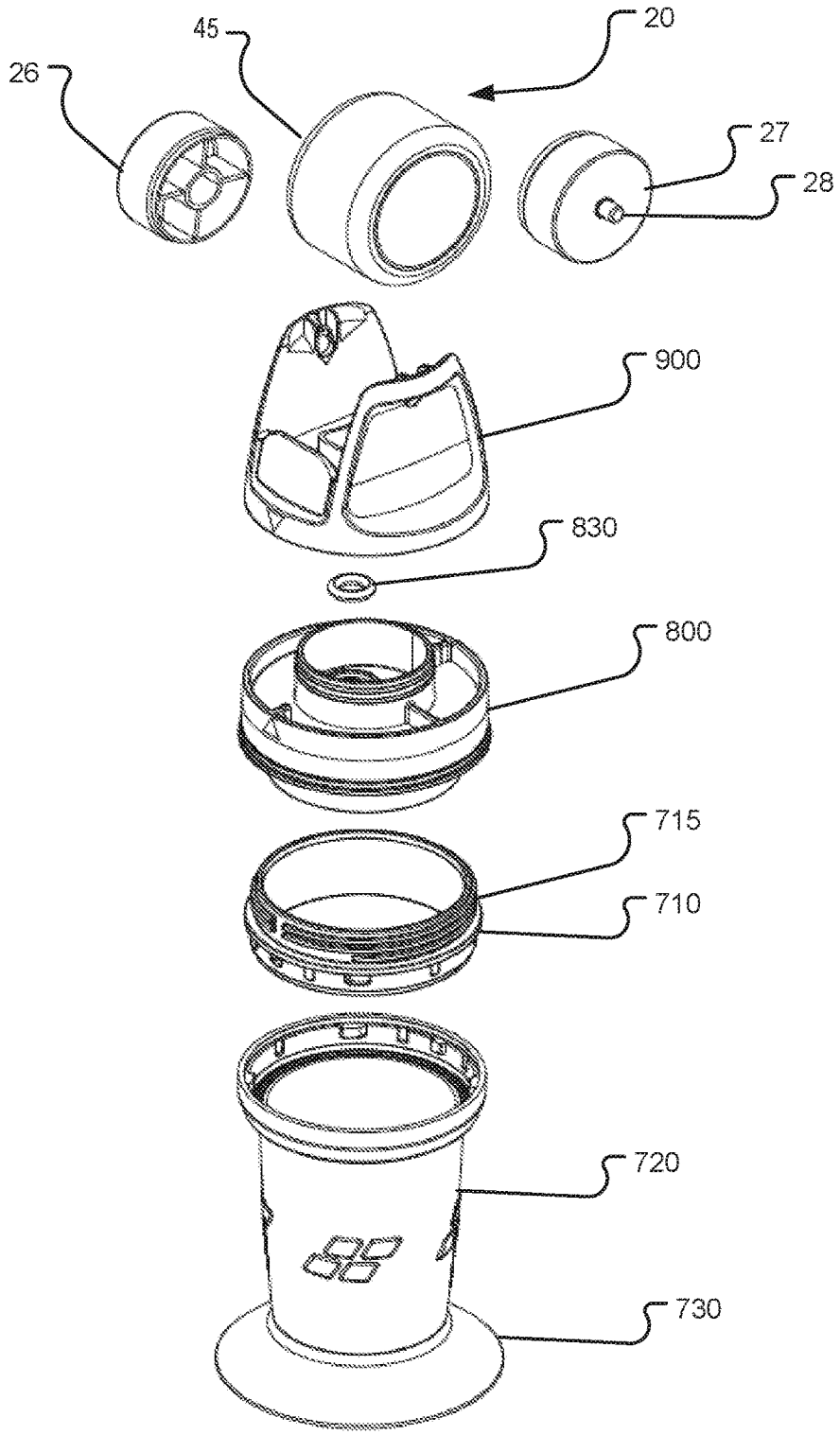
FIG. 11 shows an exploded view of an example of a liquid applicator that is constructed according to the principles of the disclosure.

Referring to FIGS. 7-8 and 11 concurrently, the top side of the body/sealing housing 800 may removably be connected to a bottom side of the liquid distribution head 900 and may further include a seal 830 (e.g., o-ring) which may be configured to prevent the liquid from being distributed when the liquid distribution head 900 is rotated in an angular orientation such as, for example, a horizontal orientation, and locked to the top side of the body/sealing housing 800 for storage of the liquid. The bottom side of the liquid distribution head 900 may include a sealant wall 930 which may be configured to lock into a corresponding protrusion 850 on the top side of the body/sealing housing 800.

The top side of the body/sealing housing 800 may further include at least one thread 840 that may be used to removably attach to the bottom side of the liquid distribution head 900 which may include a corresponding groove(s) 910. Alternatively, the top side of the body/sealing housing 800 may include a snap-fit interference engagement to seal the liquid distribution head 900 to the top side of the body/sealing housing 800.

The bottom side of the liquid distribution head 900 may include a flat raised surface 925 which may further include a aperture 920. The aperture 920 may correspond to the seal 830 on the top side of the body/sealing housing 800. When the liquid distribution head 900 and the body/sealing housing 800 are rotated in relation to each other, the seal 830 may be configured to be seated on the flat raised surface 925 and correspond to the aperture 920. This configuration will not allow a liquid to be applied to the liquid distribution head 900 and lock in the liquid.

The at least one thread 840 may further be configured such that it can only be rotated though a rotation angel of 180° degrees in relation to the body/seal housing 800. The rotation angle may vary and may further include an angle of 0° to 360° degrees. For example, at one rotation angle, there may be sufficient space between the seal 830 and the aperture 920 as to allow the liquid to be distributed to the liquid distribution head 900. This may be considered an open position. In another example, the rotation angle may lock in the liquid distribution head 900 and the body/sealing housing 800. This may result in an insufficient space between the seal 830 and the aperture 920 as to allow the liquid to be distributed to the liquid distribution head 900. This may be considered a closed position.

The liquid distribution head 900 includes a top side (as shown in e.g., FIG. 9) that may include an aperture 950 that corresponds to the aperture 920. When the liquid distribution head is in the open position in relation to the body/housing seal 800, the liquid may flow through the aperture 920 onto the aperture 950. The top side of the liquid distribution head may also include a reservoir 960 which may be configured to allow the liquid that comes through the aperture 950 to pool for distribution to a liquid applicator element 20 such as, for example, a roller head (as shown in e.g., FIG. 11). This pooling of the liquid may reduce pressure of the liquid coming through the aperture 950 and thereby lower the risk of unintended liquid ejection around the liquid applicator element 20. The liquid applicator element 20 may be held in place and supported by a supporting groove 940.

The liquid applicator element 20 may include a roller cover 45, a roller frame 26, and a roller frame cover 27. The roller cover 45 may include e.g., pile fabric, foam rubber, and the like, which may absorb a liquid coming through the aperture 950 (as shown in e.g., FIG. 9) and apply the liquid to e.g., wall. The roller frame 26 may include e.g., plastic, metal, wood, or the like, which may fit inside the roller frame 26 in order to provide structural support to the roller cover 25. The roller frame 26 may further be enclosed inside the roller frame cover 27. The roller frame cover 27 may include a rod 28 that may correspond to e.g., groove 940 (as shown in e.g., FIG. 9). The rod 28 may be configured to hold the liquid applicator element 20 on the liquid applicator element.

Furthermore, an ingress point into the reservoir 960 may be perpendicular to an ultimate direction of the liquid distribution, again further reducing the velocity of the liquid entering from the aperture 920 into the aperture 950 in the open position and thereby reducing the risk of unintended and/or uncontrolled liquid ejection.

Additionally, the liquid applicator 600 may include an internal treatment which provides the internal surfaces of the liquid applicator 600 (e.g., a reservoir, a body/seal housing, a liquid distribution head, and the like) with Oleophobic or Superhydrophobic properties. These properties will allow all of the liquid inside the liquid applicator 600 to be evacuated during use, for efficient operation and usage of the liquid. These properties may further allow a faster and more efficient clean-up of the liquid applicator 600. These properties may be incorporated into the liquid applicator 600 by a way of surface finish (e.g., cast/molded in), or a topical treatment. The topical treatment may include e.g., a solid or liquid application, and may further include a single or a multiple layers. The surface finish or the topical treatment may be permanent. Alternatively, the surface finish or the topical treatment may not be permanent and require re-application. Few examples of these treatments are described in U.S. patent application Ser. No. 13/918,938 which is incorporated herein in its entirety by reference.

The disclosure also provides a method of using a liquid applicator. In the disclosed method, a user engages a surface to be painted with a liquid applicator (as shown in, e.g., FIGS. 1-2) which includes a container 30 having a container body 33 that includes an opening and a chamber that is configured to receive and hold the liquid; and, a housing assembly 10 removably attached to the container 30, the housing assembly 10 including a liquid application element 20 and a nozzle (not shown) that delivers the liquid from the chamber 33 to the application element 20, wherein the nozzle is configured to deliver the liquid from the chamber to the application element 20 when the housing assembly 10 is positioned in a first position with respect to the container 30, and wherein the container body 33 includes an interface 37, a main body portion 35, and a base 40.

The disclosure also provides a method for manufacturing a liquid applicator. The liquid applicator which includes a container, a housing assembly, and a cap may be manufactured by injection molding, injection stretch blow molding, thermoforming, extrusion blow molding, injection blow molding, insert molding, co-injection molding, rotational molding, and other methods known in the art.

While the disclosure has been described in terms of exemplary embodiments, those skilled in the art will recognize that the disclosure can be practiced with modifications in the spirit and scope of the appended claims. These examples are merely illustrative and are not meant to be an exhaustive list of all possible designs, embodiments, applications or modifications of the disclosure.

What is claimed is:

1. A liquid applicator for applying a liquid to a surface, comprising:

a container having a container body that comprises an opening and a chamber that is configured to receive and hold the liquid; and a sealing housing having a first side and a second side, the first side removably connectable to the container body; and, a housing assembly removably attachable to the second side of the sealing housing, the housing assembly includes a sealant wall configured to lock by rotation into a corresponding protrusion on the second side of the sealing housing, wherein the container body comprises an interface, a main body portion, and a base, the interface removably attachable to the main body portion.

2. The liquid applicator of claim 1, wherein the interface is integrally formed with the main body portion and the base.

3. The liquid applicator of claim 1, wherein the main body portion comprises a wall having a substantially uniform thickness.

4. The liquid applicator of claim 1, wherein the main body portion comprise a wall that tapers such that the diameter of the main body portion proximate the base is smaller than the diameter of the main body portion proximate the interface.

5. The liquid applicator of claim 1, wherein the interface comprises at least one thread.

6. The liquid applicator of claim 1, further comprising a cap, wherein the cap is configured to be affixed to the housing assembly, so as to envelope and enclose the applicator element.

7. The liquid applicator of claim 1, wherein the main body portion comprises a wall made of polypropylene (PP).

8. The liquid applicator of claim 7, wherein the main body portion further comprises an overmold material.

9. The liquid applicator of claim 8, wherein the overmold material comprises a thermoplastic elastomer (TPE).

10. The liquid applicator of claim 1, wherein the container is substantially translucent or transparent.

11. The liquid applicator of claim 1, wherein the container body comprises a material that is configured to flex in response to a force applied to the container body, thereby allowing a user to force the liquid from the chamber and through the opening by squeezing the container body.

12. The liquid applicator of claim 1, wherein the application element comprises a flocked foam.

13. The liquid applicator of claim 1, wherein the application element comprises an adhered fabric.

14. The liquid applicator of claim 1, wherein the base of the container body is configured to contact a surface and support the liquid applicator in a predetermined position.

15. The liquid applicator of claim 1 further comprising an internal treatment which provides an internal surface of the liquid applicator with Oleophobic or Superhydrophobic properties.

16. The liquid applicator of claim 1, wherein the sealing housing has an outermost circumference circular in shape and an aperture configured on the second side, the second side having a seal positioned thereon around and proximate the aperture.

17. The liquid applicator of claim 1, further comprising a seal configured on the second side of the sealing housing and configured to seat against a flat raised surface of the housing assembly when the sealing housing and the housing assembly are rotated in relation to one another, the flat raised surface includes an aperture.

18. The liquid applicator of claim 17, wherein rotation of the sealing housing and the housing assembly relative to one another allows distribution of the liquid in an open position and prevents distribution of the liquid in a closed position.

19. A container, comprising:

a chamber that receives and holds a liquid;

a sealing housing having a first side and a second side, the second side connectable to the chamber;

a distribution head connectable to, and rotatable in relation with, a first side of the sealing housing, wherein rotation of the distribution head in relation to the sealing housing permits liquid flow in an open position and prevents liquid flow in a closed position; and a container body that comprises an interface, a base and a main body that has an annular side wall extending upward and outward from a periphery of the base, the interface removably attachable to the main body, wherein the annular side wall forms the chamber and wherein the container body comprises an opening that provides access to the chamber and allows the liquid to pass there-through.

20. The liquid applicator of claim 19, wherein the sealing housing has an outermost circumference circular in shape and an aperture configured on the second side, the second side having a seal positioned thereon around and proximate the aperture, the aperture for allowing the liquid to pass there-through.

21. An applicator comprising a container, wherein the container further comprises:

a chamber that receives and holds a liquid;

a container body that comprises an interface, a base and a main body that has an annular side wall extending upward and outward from a periphery of the base, the annular side wall forms the chamber and wherein the container body comprises an opening that provides access to the chamber and allows the liquid to pass there-through, the interface removably attachable to the main body;

a distribution head connectable to, and rotatable in relation with, a first side of a sealing housing, wherein rotation of the distribution head in relation to the sealing housing permits liquid flow in an open position and prevents liquid flow in a closed position; and the sealing housing having a first side and a second side, the second side attachable to the chamber, the sealing housing for delivering liquid from the container body to the chamber.

22. The applicator of claim 21, further comprising:

a switch roller; and a cap covering the switch roller.

23. The applicator of claim 21, wherein the switch roller further comprises:

an adhered fabric; or a flocked foam, and wherein the liquid further comprises:

a paint;

a lacquer;

a sealer;

an ink;

a varnish;

a stain; or a dye; and wherein the main body comprises a thermoplastic elastomer; or the main body comprises a thickness of about 1.5 mm, wherein the base comprises a thermoplastic elastomer; or the base is formed as a single piece with the main body.

24. The applicator of claim 21, wherein the base is connected to the main body with an adhesive.

25. The liquid applicator of claim 21, wherein the sealing housing has an outermost circumference circular in shape and an aperture configured on the second side, the second side having a seal positioned thereon around and proximate the aperture, the aperture for allowing the liquid to pass there-through.

* * * * *